US007134966B1

(12) United States Patent
Tice

(10) Patent No.: US 7,134,966 B1
(45) Date of Patent: Nov. 14, 2006

(54) GOLF PUTT TRAINING DEVICE AND METHOD

(76) Inventor: Robert M. Tice, 23 Providence Ave., Doylestown, PA (US) 18901

( * ) Notice: Subject to any disclaimer, the term of this patent is extended or adjusted under 35 U.S.C. 154(b) by 155 days.

(21) Appl. No.: 10/657,293

(22) Filed: Sep. 8, 2003

Related U.S. Application Data

(60) Provisional application No. 60/409,430, filed on Sep. 10, 2002.

(51) Int. Cl.
*A36B 69/36* (2006.01)

(52) U.S. Cl. ..... 473/220; 473/219

(58) Field of Classification Search ..... 473/156, 473/219, 220, 221, 222–225, 257, 261–265, 473/268, 269
See application file for complete search history.

(56) References Cited

U.S. PATENT DOCUMENTS

| | | | | | |
|---|---|---|---|---|---|
| 3,680,860 | A * | 8/1972 | Elkins. Jr. | 473/409 |
| 3,741,662 | A * | 6/1973 | Pioch | 356/399 |
| 3,752,588 | A * | 8/1973 | Chapman | 356/141.1 |
| 5,141,307 | A * | 8/1992 | Bennett | 356/3.01 |
| 5,207,429 | A | 5/1993 | Walmsley | |
| 5,388,831 | A * | 2/1995 | Quadri et al. | 473/220 |
| 5,472,204 | A * | 12/1995 | English et al. | 473/220 |
| 5,527,041 | A | 6/1996 | Terry, III et al. | |
| 5,628,694 | A * | 5/1997 | O'Connor, Jr. | 473/157 |
| 5,788,582 | A * | 8/1998 | Shapiro | 473/220 |
| 5,788,588 | A | 8/1998 | Hooker | |
| 5,818,036 | A | 10/1998 | Daly | |
| 5,879,239 | A | 3/1999 | Macroglou | |
| 5,964,668 | A * | 10/1999 | Tai et al. | 473/220 |
| 6,007,436 | A | 12/1999 | Mark | |
| 6,036,608 | A | 3/2000 | Morris | |
| 6,071,202 | A | 6/2000 | Densberger et al. | |
| 6,213,887 | B1 | 4/2001 | Carney | |
| RE37,519 | E | 1/2002 | Densberger et al. | |
| 6,502,319 | B1 * | 1/2003 | Goodrich et al. | 33/286 |
| 6,758,760 | B1 * | 7/2004 | Kellogg et al. | 473/220 |
| 6,769,992 | B1 * | 8/2004 | Domulevicz et al. | 473/2 |
| 6,796,910 | B1 * | 9/2004 | Foster | 473/220 |
| 6,840,869 | B1 * | 1/2005 | Chen | 473/220 |
| 6,895,677 | B1 * | 5/2005 | Dinicola | 33/289 |
| 6,935,034 | B1 * | 8/2005 | Malard et al. | 33/286 |
| 2002/0178596 | A1 * | 12/2002 | Malard et al. | 33/286 |

* cited by examiner

*Primary Examiner*—Nini F. Legesse
(74) *Attorney, Agent, or Firm*—William J. Stoffel

(57) ABSTRACT

A golf putt training device which is characterized as follows. A light apparatus adapted to project an alignment segment and an aiming spot on a playing surface. Whereby the light apparatus is positioned behind a ball and the aiming spot is projected in front of the ball. The alignment segment is projected over the ball and a putter head. The alignment segment is used to align the putter head during a swing. The method for putt training can begin by projecting an alignment segment and an aiming spot from a light apparatus positioned above a playing surface onto a playing surface. A ball is positioned on a portion of the alignment segment on the playing surface. A putter head of a putter is placed behind the ball on a portion of the alignment segment. The putter head is aligned with the alignment segment. The putter head is moved to strike the ball using the alignment segment to maintain the alignment of the putter head with the alignment segment. In an option the light apparatus is comprised of a first light source and a second light source The first light source projects the alignment segment and the second light source projects the aiming spot. The alignment line and the aiming spot are about in a vertical plane.

20 Claims, 9 Drawing Sheets

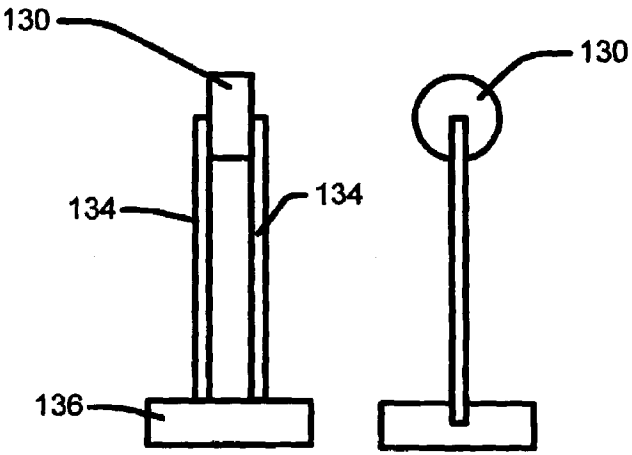
FIG. 6C
FIG. 6D
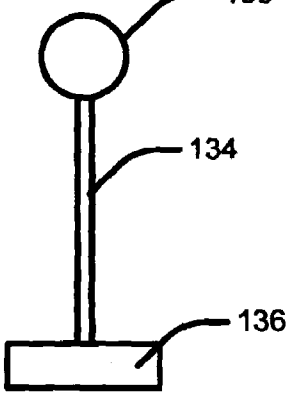
FIG. 6B
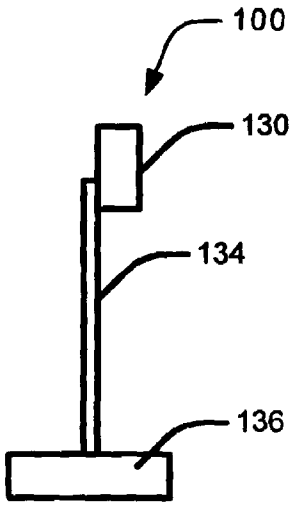
FIG. 6A

GOLF PUTT TRAINING DEVICE AND METHOD

CROSS REFERENCE TO RELATED APPLICATIONS

This application is based on U.S. Provisional Application Ser. No. 60/409,430, filed on Sep. 10, 2002, which disclosure is incorporated herein by reference for all purposes.

BACKGROUND OF INVENTION

1) Field of the Invention

The present invention relates generally to putting aids and more specifically it relates to putt training devices and methods for training golfers to putt consistently and accurately.

2) Description of the Prior Art

It can be appreciated that laser putting aids have been in use for years. Typically, laser putting aids are comprised of customized training putters that incorporate a built in laser, and laser devices that attach to a putter. Another class of laser putting aids project a laser beam from a target back to the putter.

The main problem with conventional laser putting aids are in the case of customized training putters the golfer is not practicing with his own putter, which is a significant disadvantage. In the case of attached laser devices, they affect the mechanical properties of the putter, which is a significant disadvantage. In the final case, laser beams projected from the target back to the putter address only one aspect of the putting stroke; either face alignment or swing path.

Another problem with conventional laser putting aids are in the case of customized training putters, they cannot be used on the golf course in accordance with the rules of golf. In the case of attached laser devices, they cannot be used on the golf course in accordance with the rules of golf. Another problem with conventional laser putting aids is they do not address the entire putt stroke. Typically each putting aid addresses only one aspect of the putting stroke, either putter face alignment, swing path alignment with the target, distance control, target selection, or parallex aiming issues.

While these devices may be suitable for the particular purpose to which they address, they are not as suitable for training golfers to putt consistently and accurately. The main problem with conventional laser putting aids are in the case of customized training putters the golfer is not practicing with his own putter, which is a significant disadvantage. In the case of attached laser devices, they affect the mechanical properties of the putter, which is a significant disadvantage.

The importance of overcoming the various deficiencies noted above is evidenced by the extensive technological development directed to the subject, as documented by the relevant patent and technical literature. The closest and apparently more relevant technical developments in the patent literature can be gleaned by considering U.S. Pat. No. 6,071,202 (Densberger et al) that shows a golf swing training method that projects one long (infinite) line of light.

U.S. Pat. No. 6,071,202 (Densberger et al.) shows a golf swing training method.

U.S. Pat. No. RE37,519E (Densberger et al.) shows a gold club with optical alignment system.

U.S. Pat. No. 6,213,887 B1 (Carney) shows an apparatus for practicing the game of golf.

U.S. Pat. No. 5,879,239 (Marcroglou) shows an alignment device.

U.S. Pat. No. 6,6036,608 (Morris) shows a golf putting apparatus.

U.S. Pat. No. 5,207,429 (Walmsley et al.) shows a club aiming unit.

U.S. Pat. No. 6,007,436 (Mark) teaches a laser light for putting.

U.S. Pat. No. 5,818,036 (Daly) disclose a laser putting device.

U.S. Pat. No. 5,788,588 (Hooker) teaches a putting training method.

U.S. Pat. No. 5,527,041 (Terry, III, et al.) shows a golf putting trainer.

However there is a need to improve current golf putt training devices.

SUMMARY OF THE INVENTION

It is an object of embodiments of the invention to provide a device and method for projecting a highly visible alignment segment and highly visible aiming spot.

To accomplish the above objectives, the present invention provides an embodiment of golf putt training device which is characterized as follows. A light apparatus adapted to project an alignment segment and an aiming spot on a playing surface. The aiming spot is projected in front of a ball. The alignment segment is projected over said ball and a putter head. Whereby the alignment segment is used to align the putter head during a swing.

In an aspect of the invention, the light apparatus is comprised of a first light source and a second light source; the first light source projects the alignment segment and the second light source projects the aiming spot. The alignment segment and the aiming spot are about in a vertical plane.

An embodiment for a method for putt training can begin by projecting an alignment segment and an aiming spot from a light apparatus positioned above a playing surface onto a playing surface. A ball is positioned on a portion of the alignment segment on the playing surface. A putter head of a putter is placed behind the ball on a portion of the alignment segment. The putter head is aligned with the alignment segment. The putter head is moved to strike the ball using the alignment segment to maintain the alignment of the putter head with the alignment segment.

In an option the light apparatus is comprised of a first light source and a second light source; the first light source projects the alignment segment and the second light source projects the aiming spot. The alignment line and the aiming spot are about in a vertical plane.

In an option, the training method can further include:

a) aligning a putter head mark on the putter head with the alignment line; the putter head mark about perpendicular with the face of the putter head; the alignment segment and the light apparatus defining a plane about normal to the playing surface;

b) locating an eye alignment device behind the ball along the alignment segment;

c) locating the eye of a golfer in the vertical plane above the playing surface so that the golfer can see the alignment segment on the eye alignment device;

d) adjusting the swing of the putter so that the putter head mark remains aligned with the alignment line; and e) striking a ball with the putter head.

Additional objects and advantages of the invention will be set forth in the description that follows, and in part will be obvious from the description, or may be learned by practice of the invention. The objects and advantages of the invention may be realized and obtained by means of instrumentalities and combinations particularly pointed out in the append claims.

BRIEF DESCRIPTION OF THE DRAWINGS

The features and advantages of a golf training device and method according to the embodiments of the present invention will be more clearly understood from the following description taken in conjunction with the accompanying drawings in which like reference numerals designate similar or corresponding elements, regions and portions and in which:

FIG. 3A shows the light apparatus 130 rotated down along the axis of rotation 202 for a short putt according to an aspect of the invention.

FIG. 3B shows the light apparatus 130 positioned along the axis of rotation 202 for a medium distance putt according to an aspect of the invention.

FIG. 3C shows the light apparatus 130 positioned along the axis of rotation 202 for a longer putt according to an aspect of the invention.

FIG. 5B illustrates how the eye alignment device enables the golfer to judge when her eyes are alignment in a vertical plane over the ball.

FIG. 6A is a front view of the putt training device 100 that has one riser according to an aspect of the invention.

FIG. 6B is a side view of the putt training device 100 that has one riser according to an aspect of the invention.

FIG. 6C is a front view of another embodiment of the putt training device 100 that has two risers according to an aspect of the invention.

DETAILED DESCRIPTION OF THE PREFERRED EMBODIMENTS

Example embodiments of the present invention will be described in detail with reference to the accompanying drawings. The embodiments of the present invention provide a method for a putt training and a putt training device. In one aspect, the putt training device can comprise a light apparatus and an optional eye alignment device. The light apparatus projects an (putter) alignment segment and an aiming spot on a playing surface.

Example embodiments of the invention will now be described by first referring to FIG. 1 which shows a golf putting training device 100 for use with a golf club and a ball in practicing a correct putting swing.

Figure 1:
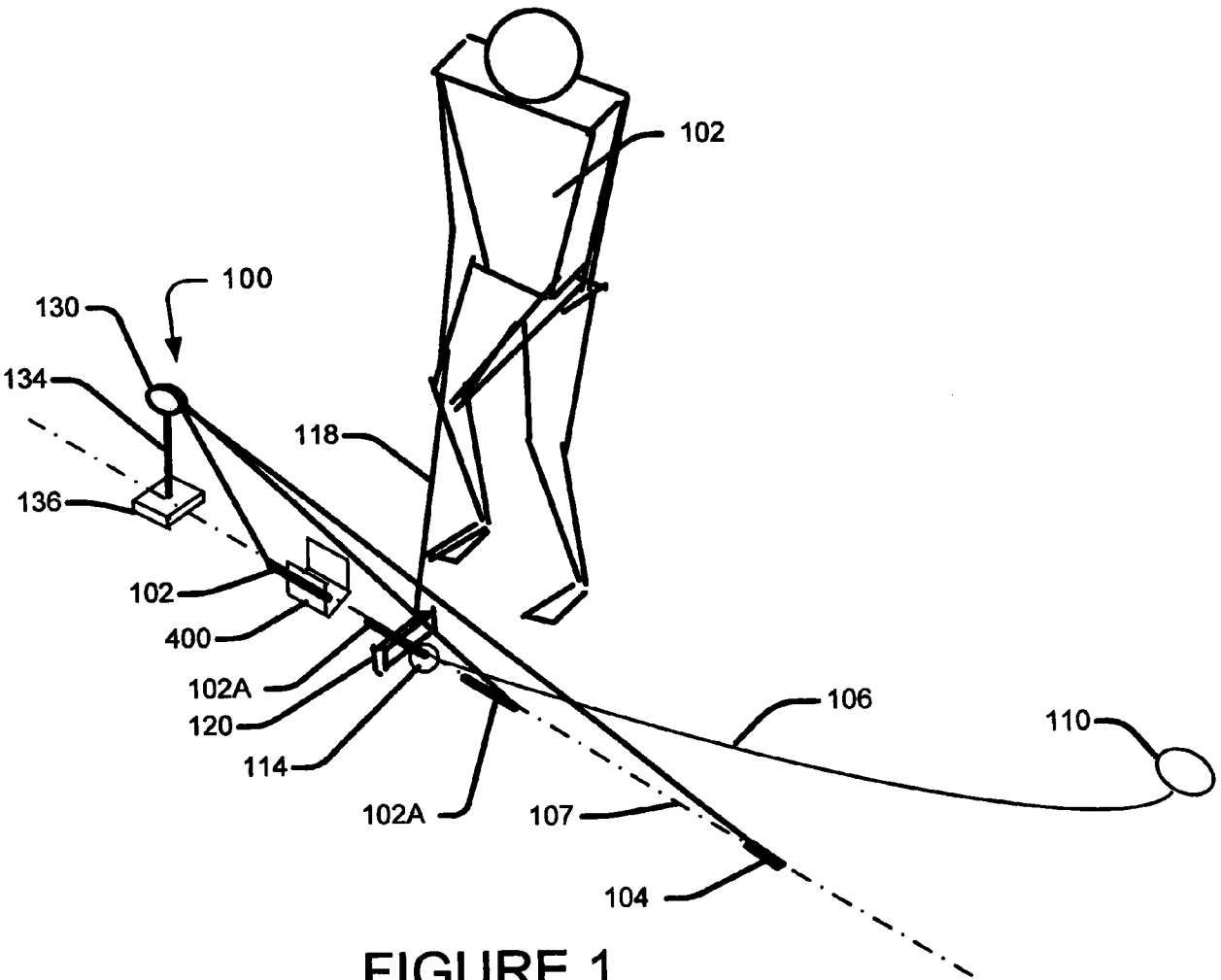
FIG. 1 shows perspective view of the golf putting training device 100 according to an aspect of the invention.

In the embodiment shown in FIG. 1, a golf putting training device 100 has a light apparatus 130 (e.g., a laser module) that projects an alignment segment 102 and an aiming spot 104 on a playing surface 112 (e.g., putting green). An eye alignment device 400 is preferably behind the ball 114. The light apparatus 130 projects visible light. The light apparatus 130 is positioned behind a ball 114 and the aiming spot 104 is projected in front of the ball. The light apparatus can be positioned in front of or behind or on the side of the ball. The (putter) alignment segment 102 is used to align a putter head 120 of a putter 118 during a swing. The alignment segment 102 is preferably projected near the ball in the area in front and behind the ball. Preferably the alignment segment 102 and the aiming spot 104 are about in a vertical plane or alignment line 107 on the playing surface (e.g., alignment plane 107).

Preferably the light apparatus does not project light between the alignment segment and the aiming spot.

The alignment segment 102 is preferably accomplished by an optical element which converts the light beam into a vertically-oriented, planar-shape, wherein the alignment 102 segment is formed at the intersection of the plane with the playing surface.

The light apparatus 130 is preferably comprised of a first light source and a second light source. Preferably, the first light source projects the alignment segment and the second light source projects the aiming spot. In an embodiment the first light source is a first laser device and the second light source is comprised of a second laser device. The light sources can be light emitting diodes or filament or arc lamps.

The first light source can be comprised of one or more laser devices. Also, the second light source can be comprised of one or more laser devices.

A first advantage of the embodiment is that the alignment segment and aiming spot are highly visible. In prior art golf devices one laser device (e.g., one LED) is used to project one laser line at least from the ball to the target (i.e., hole) and beyond. Thereby the brightness of laser line is diminished because the laser line is so long. In contrast, the embodiment concentrates the light into an alignment segment and an aiming spot. The embodiments' alignment segment 102A is shorter than the long (e.g., infinite) laser lines. Preferably no light is projected between the alignment segment and an aiming spot. Preferably no light is projected between the alignment segment and an aiming spot using the same first and second sources.

A second advantage of the embodiment is that dedicated first and second light sources (e.g., lasers) are used to project the alignment segment and aiming spot. The embodiment's use of two light sources (e.g., dedicated lasers, lamps, or filaments) allows a more concentrated light energy to be used.

The alignment segment preferably has a length between 18 inches and 36 inches long. The alignment segment can have a length between 10% and 25% of the distance between the ball and the aiming point. The alignment segment can have a length of about between 80% to about 120% of the length of the putters head 120 travel (e.g., back swing point to follow thru point) and more preferably between 100% to about 120%. The alignment segment length can be minimized to concentrate the light energy in the smallest area so that the light segment is bright and highly visible.

The aiming spot 104 is preferably a point of light. The aiming spot can be small area of any shape but is preferably a point or segment with a length between 0.05 inch and 8 inches and preferably between 0.1 inch and 4 inches.

As shown in FIG. 1, in an embodiment the alignment segment 102 is comprised of disconnected line segments 102A or a series of dashes 102A. In a preferred embodiment the disconnected line segments have a length between about 0.5 and 2.0 inches.

The alignment segment is preferably accomplished by an optical element which converts the light beam into a vertically-oriented, planar-shape, wherein the alignment segment is formed at the intersection of the plane with the playing surface or other object.

In an aspect, the putt training device 100 can be comprised of a base 136, a riser 134 and a light apparatus 130. In an aspect, the putt training device is comprised of a mounting means for mounting the light apparatus above the playing surface.

FIG. 1 shows a golfer 102 who is holding a putter 118 having a putter head 120. The golfer is attempting to strike the ball 114 with the putter head 120 on an intended target path 106 to a target 110 (e.g., golf hole). The intended target path is the path the ball is intended to take to the target (e.g., hole). The alignment segment 102 and the aiming spot 104 are not collinear or co-planar with the intended target path 106 (ball path) since the playing surface is not perfectly flat and has topology that may curve the path of the ball. No playing surface is perfectly flat. The intended target path 106 is the path the ball will follow from the ball starting point to the target. The intended target path 106 is tangential to the alignment segment 102.

In the example shown in FIG. 1, the aiming spot 104 is to the right of the target 110 because the playing surface 112 has a topology that can curve the path of the ball to the left. The golfer aims at an aiming point that is not perfectly aligned with the hole because the playing surface is not perfectly flat or level. Most times, the aiming spot is closer to the ball than the hole. For example on FIG. 1, the aiming spot 104 is closer to the ball 114 than the target 110. The golfer uses her judgment as to the curve of the playing surface.

Figure 2:
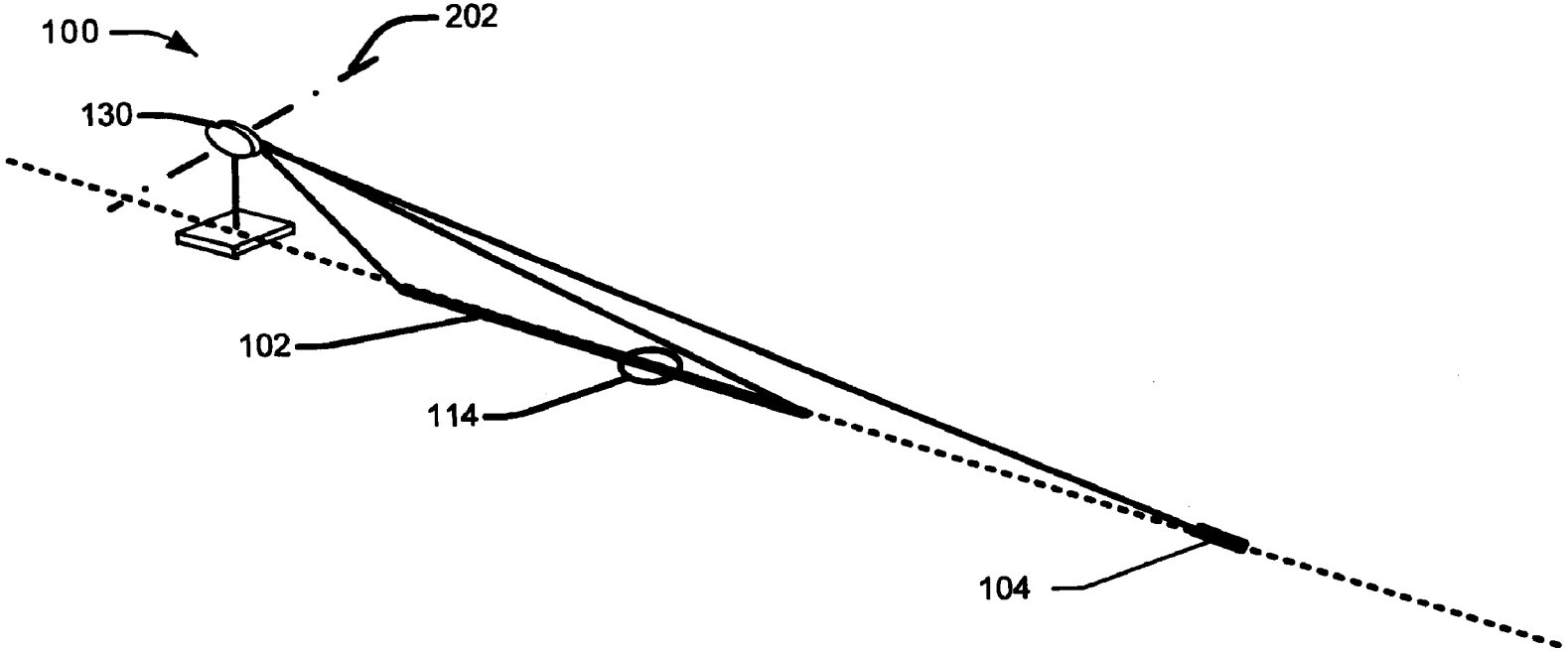
FIG. 2 shows a perspective view of the putt training device 100 projecting the alignment segment 102 according to an aspect of the invention.

FIG. 2—puff training device

FIG. 2 shows a perspective view of the putt training device 100 projecting the alignment segment 102. In an embodiment the light apparatus can pivot on a vertical plane on the axis of rotation 202. This allows the alignment segment and aiming spot to be adjusted. By adjusting the light apparatus (refer to FIGS. 3A, 3B, and 3C) the golfer can set the length of the alignment segment and aiming spot. The light apparatus 130 can be mounted in other ways.

Figure 3A:
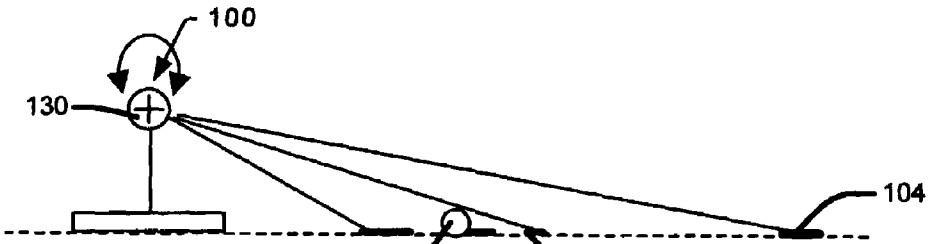
FIGS. 3A, 3B and 3C are side views of the training device showing how the light apparatus can be rotated for a short putt, a medium putt and a long putt according to aspects of the invention.
Figure 3B:
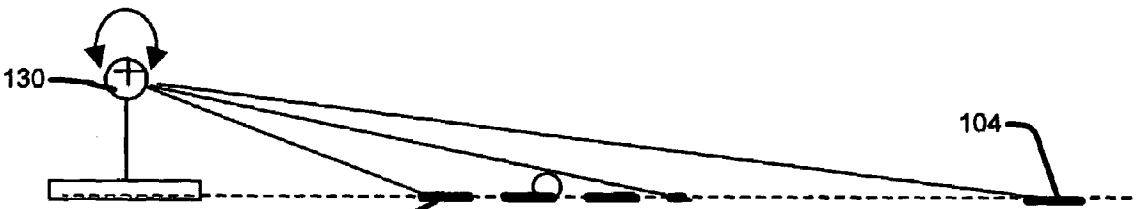
Figure 3C:
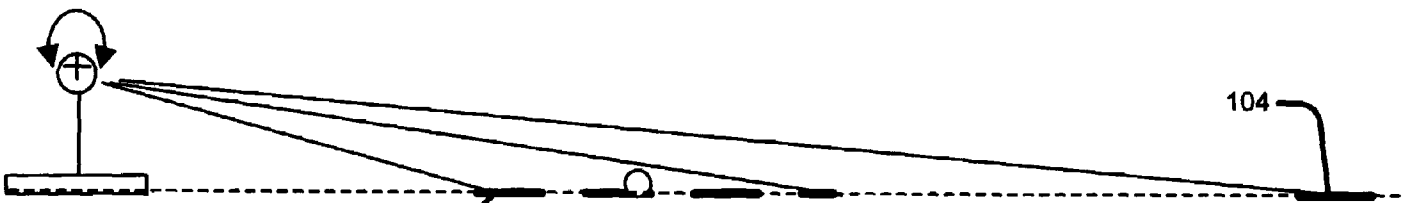

FIGS. 3A 3B and 3C—Light Apparatus Rotated for Different Puff Lengths FIGS. 3A, 3B and 3C are side views of the training device showing how the light apparatus can be rotated for a short putt, a medium putt and a long putt.

FIG. 3A shows the light apparatus 130 rotated down along the axis of rotation 202 for a short putt.

FIG. 3B shows the light apparatus 130 positioned along the axis of rotation 202 for a medium distance putt.

FIG. 3C shows the light apparatus 130 positioned along the axis of rotation 202 for a longer putt.

The light apparatus preferably pivots in a vertical plane. As shown in FIGS. 3A, 3B and 3C, rotating the light apparatus counter-clockwise increases the distance to the aiming spot as well as the length of the alignment segment. Conversely, rotating the light module clockwise decreases the distance to the aiming spot as well as the length of the alignment segment.

Figure 4:
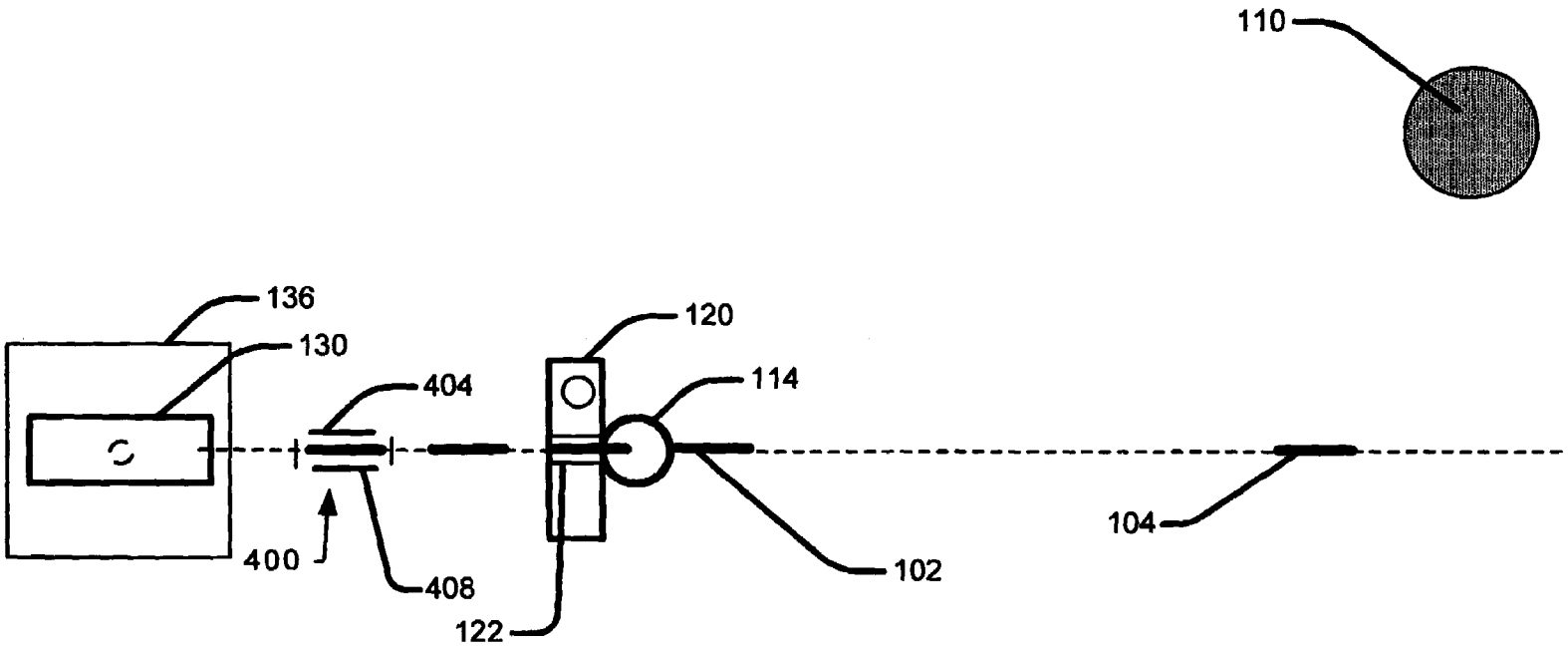
FIG. 4 shows a top down view of an embodiment of the putt training device comprising an eye alignment device 400 preferably positioned behind the ball 114 along the alignment segment 102 according to an aspect of the invention.

FIG. 4—Eye Alignment Device

FIG. 4 shows a top down view of an embodiment of the putt training device comprising an eye alignment device 400 (e.g., parallax error eliminator device) preferably positioned behind the ball 114 along the alignment segment 102 whereby the eye alignment device 102 allows a golfer's eyes to be maintained about in the vertical plane over the ball. The eye alignment device has a means for defining a plane where parallax has been eliminated. Parallax is an apparent change in the direction of an object, caused by a change in observational position that provides a new line of sight.

The eye alignment device 400 is preferably comprised of two spaced about vertical panels 404 408. (See FIG. 5A).

Puffer Head Marks

Still referring to FIG. 4, the putter preferably further comprises a putter head mark 122 on the top of the putter head 120. The putter head mark(s) 122 are preferably about perpendicular with the face 123 of the putter. The putter head mark(s) is on the "sweet spot" of the putter head. The putter head mark(s) is preferably one or more lines on the top of the putter head. The putter head mark(s) can be non-reflective so that the alignment segment can not be seen by the golfer when the putter head mark(s) is aligned with the alignment segment. The top surface of the putter head can be reflective (e.g., polished chrome) so that the alignment segment reflects up to the golfer when the alignment segment is not aligned with the putter head mark. In addition, the putter head mark can be reflective and the top surface of the putter head can be non-reflective. Also, the putter alignment mark(s) can be groves or raises areas in the putter head. Other configurations of the putter head and putter head marks are possible.

Visual alignment aids that can be incorporated into putter designs are primarily perpendicular grooves located on top of the putter blade, or, in the case of a mallet-design putter, on the top surface of the sole. Such grooves can be highlighted by the use of white, black, red, or other contrasting colors of paint or colored inserts. The grooves, viewed in combination with the putter blade, are used to align the face of the putter with the direction aimed.

During use, the swing of the putter is adjusted so that the putter head mark remains aligned with the alignment segment that is projected on the top of the putter head. For example, the light segment 102 can be maintained on or between the putter head marks that can be lines perpendicular to the putter face. This ensures that the putter is orthogonal to the alignment segment and that the "sweet spot" of the putter is aligned with the center of the golf ball.

Figure 5A:
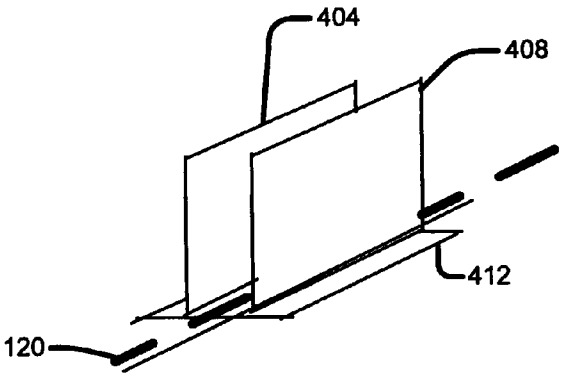
FIG. 5A shows a perspective view of embodiment of an eye alignment device 400 according to an aspect of the invention.
Figure 5C:
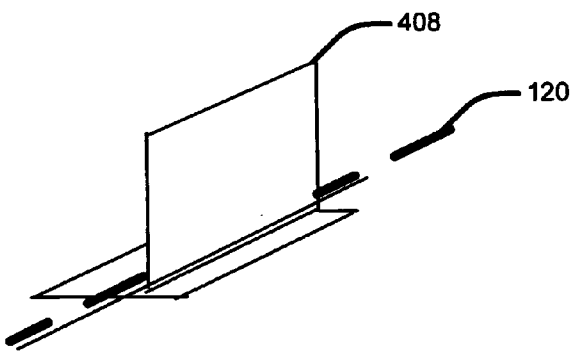
FIG. 5C snows a perspective view of embodiment of an eye alignment device with one about vertical panel according to an aspect of the invention.
Figure 5B:
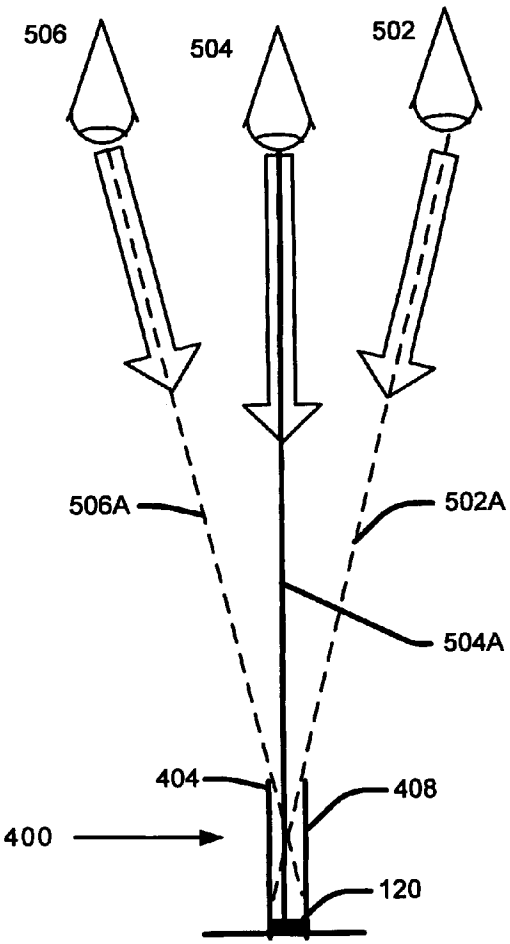
FIG. 5B shows a cross sectional view of the eye alignment device 400 according to an aspect of the invention.

FIGS. 5A, 5B and 5C—Eye Alignment Device

The eye alignment device 400 is comprised of at least one about vertical panel that can be supported in any way. FIG. 5A shows a perspective view of embodiment of an eye alignment device 400. The eye alignment device 400 is preferably comprised of two spaced about vertical panels 404 408 and a base 412. As shown in FIGS. 1 and 4, the eye alignment device 400 is positioned behind the ball with the alignment segment 120 positioned between the vertical panels 404 408. The eye alignment device allows a golf's eyes to be maintained in the vertical plane over the ball.

Referring to FIG. 5A, an embodiment of the eye alignment device (e.g., Parallax Error Eliminator device) is comprised of two parallel vertical panels 404 408 mounted to a base panel. The panels are preferably spaced between about 1/16 and 3/16 inch apart and most preferably approximately 1/8 inch apart. The eye alignment device is placed within the alignment segment such that the segment lays in (the trough) between the panels 404 408.

In another aspect, the eye alignment device is comprised of only one vertical panel. The golfer can look down the vertical panel/plane seeing it as a line parallel to and next to the laser segment. For example, as shown in FIG. 5C, the eye alignment device is comprised of a vertical panel 408. Other examples of single panels for eye alignment device aspect include, a panel from a box or a L-shaped device with a vertical panel and a bottom base. Another example is a panel that is supported by stakes secured in/on the playing surface.

The eye alignment device is preferably not attached to the golf club or golfer.

FIG. 5B illustrates how the eye alignment device enables the golfer to judge when her eyes are alignment in a vertical plane over the ball.

The golfer's eye are shown in three positions 502 504 506 along with the corresponding line of sight 502A 504A 506A.

If the golfer's eyes are not in the vertical plane the eye alignment device 400 (e.g., Parallax Error Eliminator) will block the alignment segment 102 (e.g. laser line) from the golfer's view. For example, when the golf's eye 502 504 is not in the vertical plane, the golfer can not see the (laser light) alignment segment between the panels 404 408. When the golfer's eyes 504 are in the vertical plane, the golfer can the alignment segment 102 (laser line) between the panels.

The eye alignment device 400 can be made of any material and can be scaled to any size that provide its function. The vertical panels 404 408 can have a height so that if the golfer's eye's are not aligned over the alignment line, the panels will block the golf's sight of the alignment segment between the panels.

As shown in FIG. 1, when the eye alignment device 400 is to be used it is placed preferably behind the golf ball beyond the swing path of the putter so that the alignment segment lies between the panels.

FIGS. 6A, 6B, 6C, and 6D—Putt Training d Vice

FIG. 6A is a front view of an embodiment of the putt training device 100 that has one riser.

FIG. 6B is a side view of the an embodiment of the putt training device 100 that has one riser.

FIG. 6C is a front view of another embodiment of the putt training device 100 that has two risers. This embodiment is preferred over the one riser embodiment because the two risers have more stability than one riser. Preferably the two risers are collapsible and extendable.

FIG. 6B is a side view of the another embodiment of the putt training device 100 that has two risers.

Figure 7:
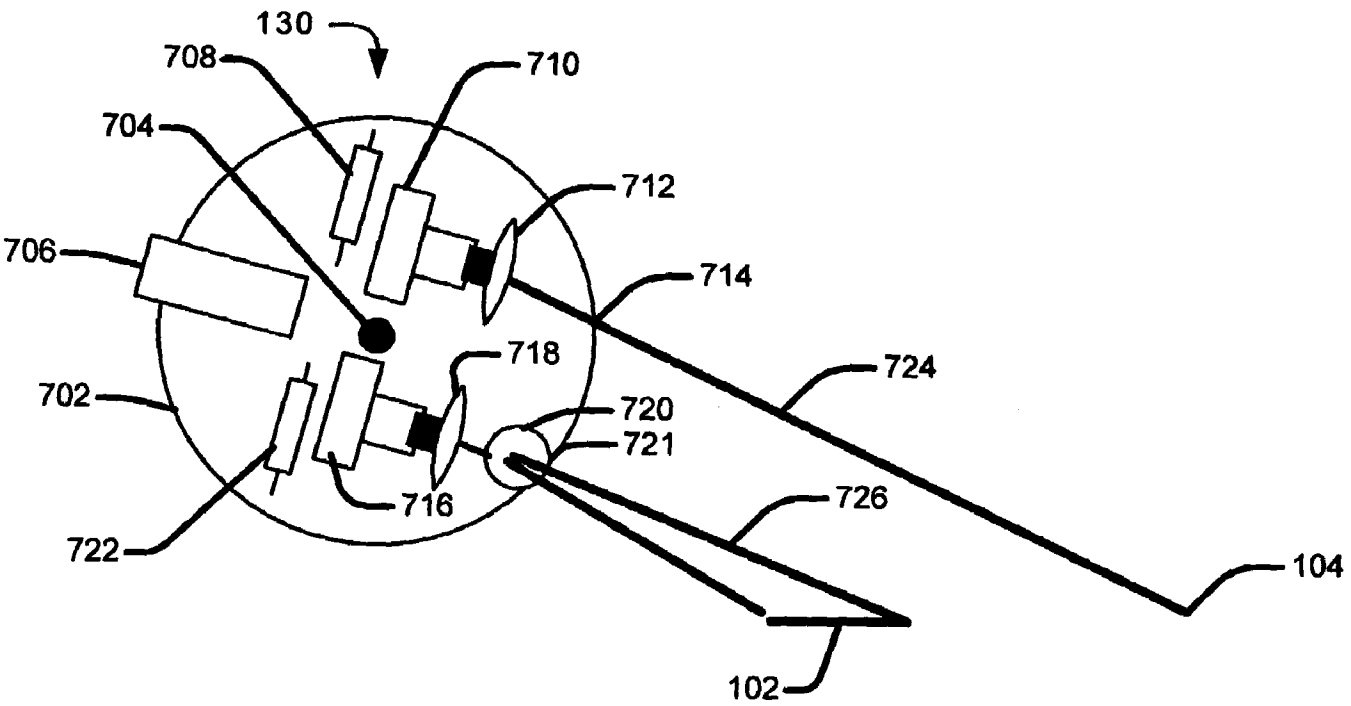
FIG. 7 shows a cross sectional view of an embodiment of the light apparatus 130.

FIG. 7—Light Apparatus 130

FIG. 7 shows cross sectional view of an embodiment of the light apparatus 130. The light apparatus 130 is preferably comprised of a laser module enclosure 702, a pivot hub and axis of rotation 704, a power receptacle 706, two current limiting resistors 708 722, two laser diodes 710 716, two collimating lenses 712 718, windows for the laser beams 714 721, and a beam spreader 720.

The light apparatus 130 (e.g., Laser Module) preferably generates two co-planar visible laser beams using laser diodes and optics. One beam 726 is spread and preferably "chopped" to create a graticulated laser segment. The other beam 724 is aimed in line with the laser segment but forward and beyond it. Each laser beam preferably has it own laser source.

The light apparatus connects to the Riser, pivoting on the axel of the Riser. A power cord connects to the laser module from the Base Module. The device 100 stands between 10 to 18 inches high and preferably approximately 14 inches high. The riser can nave a length between 4 inches (e.g., collapsed) and 16 inches (e.g., fully extended).

Although FIG. 7 shows a light apparatus comprised of two laser diodes and a specific optical implementation, This aspect is not limited to the configuration shown in FIG. 7. The embodiment can provide a coplanar alignment segment and an aiming spot in many ways. For example, a single laser could be used by splitting its beam and then generating a segment from one split beam and a spot from the other. Although, specific optics are shown this embodiment does not rely a specific optic implementation.

Figures 8A, 8B:
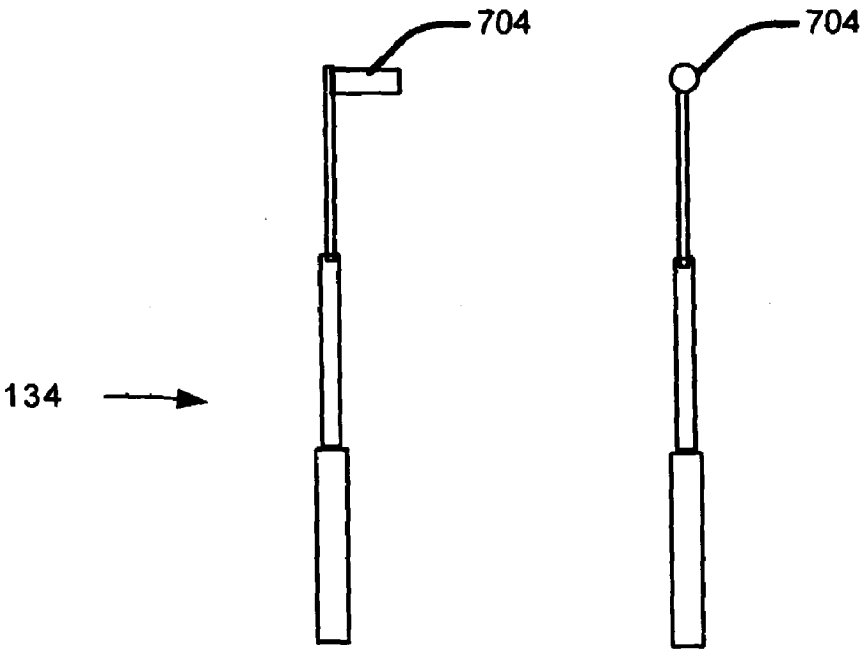
FIG. 8A shows a side view of an embodiment of the riser 134 where the riser is comprised of a collapsible structure according to an aspect of the invention.
FIG. 8B shows a side view of the embodiment of the riser 134.

FIGS. 8A and 8B—Embodiment of the Riser(S)

FIG. 8A shows side view of an embodiment of the riser 134 where the riser is comprised of a collapsible structure, such as nested concentric cylinders (e.g., like a collapsible car antenna).

FIG. 8B shows a side view of the embodiment of the riser 134.

The riser supports the light apparatus 130 (Laser Module). It provides an axle pin 704 that the light apparatus 130 (Laser Module) mounts to and rotates on. The Riser preferably collapses for storage. The riser preferably is collapsible so as to ease storage and carrying the Putt training device. The riser is adjustable in its height so as to provide the optimum height for the light apparatus. The riser supports the light apparatus. It can be made of any material that mechanically supports the light apparatus. In certain cases the riser may be fixed and not extensible.

Figure 9A:
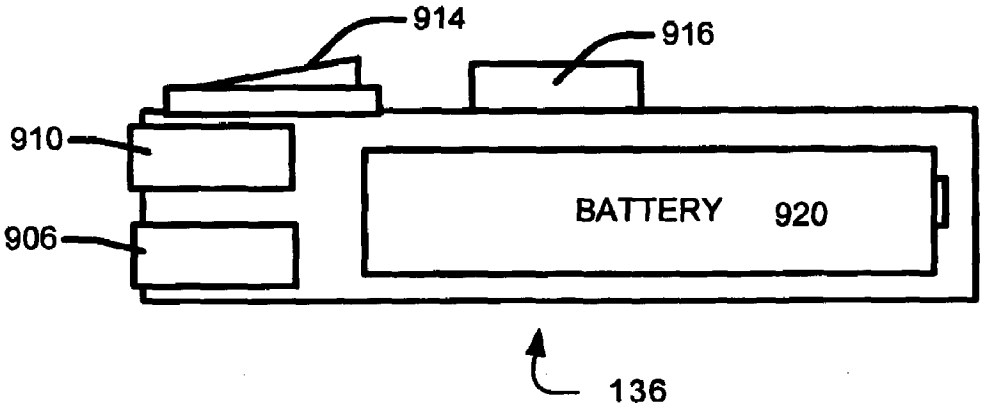
FIG. 9A shows a simplified cross sectional side view of the base 136 according to an aspect of the invention.
Figure 9B:
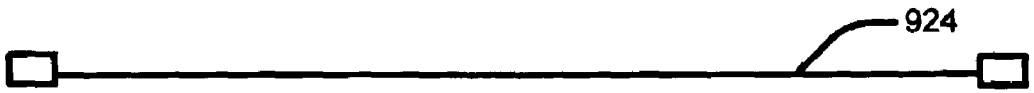
FIG. 9B shows a power cable 924 that goes between the base and the laser module according to an aspect of the invention.

FIGS. 9A and 9B—Base and Power Cable

FIG. 9A shows a simplified cross sectional side view of the base 136.

The base 136 contains batteries 920, a power switch (914), an output power connector (910), and an alternate external DC power receptacle (906). The batteries provide power to the light apparatus (e.g., Laser Module). The power switch 914 provides for turning power on and off to the light apparatus. The Output Power Connector 910 delivers power through a power cord 924 (FIG. 9*b*) to the light apparatus (e.g., Laser Module). The Alternate External DC Power Receptacle 906 accepts external dc power from an AC to DC converter module that plugs into a 115 VAC wall outlet. When external power is available the batteries are electrically dormant.

The Base Module provides the mechanical support for the riser and light apparatus (Laser Module). The Base Module can be made of any material and have any shape that provides a suitable base for supporting the riser and light apparatus.

FIG. 9B shows a power cable 924 that goes between the base and the light apparatus (Laser Module). The power cable can be routed inside of the riser to the light apparatus.

II. Method Embodiments

Referring to FIGS. 1, 2, 3A, 3B, 3C and 4, an embodiment for a method for putt training can begin by projecting an alignment segment 102 and an aiming spot 104 from a light apparatus 130 onto a playing surface 112. The light apparatus is positioned above a playing surface behind the ball, putter and target (e.g., hole). The location or direction "behind the ball" is in reference to the target. The location in front of the ball is also in reference to the target. The location in front of the ball is about between the ball and the target (e.g., hole).

To practice short putts the golfer turns on the power switch and then positions and rotates the light apparatus (Laser Module) until the desired alignment segment and aiming spot are formed.

Next, a ball 114 is positioned on a portion of the alignment segment 102 on the playing surface. Preferably the golfer locates a golf ball near the middle of the graticuated alignment segment such that the light alignment segment bisects the ball.

A putter head 120 of a putter is placed behind the ball 114 on a portion of the alignment segment 102. The putter head 120 is aligned with the (putter) alignment segment 102. The golfer preferably places the putter behind the ball with the putter head alignment mark illuminated by the laser segment. This ensures that the putter is orthogonal to the putting line and that the "sweet spot" of the putter is aligned with the center of the golf ball to be putted. The order of these steps can be performed in any sequence.

The golfer pulls the putter back attempting to maintain the laser alignment segment on the putter head mark. The golfer can gage how far to pull back the putter by watching the segments (graticules) 102A of the laser alignment segment. This promotes distance control in putting.

The putter head 120 is moved to strike the ball 114 using the alignment segment 102 to maintain the alignment of the putter head with the alignment segment 102. After completing the back stroke, the golfer starts the putter forward on the laser segment while maintaining the putter head mark(s) on the laser segment 102. The golfer continues the stroke through the golf ball while maintaining putter alignment with the laser segment 102. When the golfer strikes the ball while maintaining alignment with the laser segment 102, the ball will roll towards the laser aiming spot 104 and will be illuminated by the laser aiming spot beam.

In an option the light apparatus 130 is comprised of a first light source and a second light source. Preferably, the first light source projects the alignment segment and the second light source projects the aiming spot, Preferably, the alignment segment and the aiming spot are about in a vertical plane 107.

Referring to FIG. 4, the training method can which further include aligning a putter head mark 122 on the putter head 120 with the alignment segment. The putter head mark is about perpendicular with the face 123 of the putter head. The alignment segment 102 and the light apparatus 130 a plane about normal to the playing surface.

The putter can further comprises a putter head mark(s) on the top of the putter head that about perpendicular with the face of the putter. Wherein the swing of the putter is the adjusted so that the putter head mark remains aligned with the alignment segment.

Eye Alignment Device

An aspect of the invention is a method and apparatus for aligning putter face in a desired direction and includes a eye alignment system having a means for defining a plane where parallax has been eliminated. The eye alignment device/system is comprised of a vertical plane that is aligned with light projected in an alignment plane (e.g. 107).

The golfer can incorporate the eye alignment device (Parallax Error Eliminator device) into practice sessions by locating the eye alignment device 400. As shown in FIGS. 4, 5A and 5B, this will ensure that the golfer is practicing with his/her eyes over the golf ball. When preparing to putt the golfer can check that the laser line is in view, this will ensure proper head position.

An eye alignment device 400 is located behind the ball along the alignment segment.

Next, the eye of a golfer is located in the vertical plane above the playing surface so that the golfer can see the alignment segment on the eye alignment device.

The swing of the putter is adjusted so that the putter head mark 122 remains aligned with the alignment line.

Lastly, the ball 114 is struck with the putter head.

The putt head continues on the follow through and the golf attempts to maintain the segment line aligned with the putter head mark 122.

As shown in FIGS. 5A and 5B, the eye alignment device is comprised of two spaced about vertical panels. The eye alignment device is positioned behind the ball with the alignment segment positioned between the vertical panels. The golfer's eyes are preferably maintained in the vertical plane over the ball using the eye alignment device.

In an example embodiment shown in FIG. 1, the alignment segment 102 consists of a series of disconnected line segments 1 02A wherein a golfer can gage how far to pull back the putter head by watching the dashes of the first projected line of light thus promotes distance control in putting.

Given the variety of embodiments and aspects of the present invention just described, the above description and illustrations should not be taken as limiting the scope of the present invention defined by the claims.

While the invention has been particularly shown and described with reference to the preferred embodiments thereof, it will be understood by those skilled in the art that various changes in form and details may be made without departing from the spirit and scope of the invention. It is intended to cover various modifications and similar arrangements and procedures, and the scope of the appended claims therefore should be accorded the broadest interpretation so as to encompass all such modifications and similar arrangements and procedures.

What is claimed is:

1. A golf putt training device comprising:

a light apparatus adapted to project an alignment segment and an aiming spot on a playing surface; said alignment segment is comprised of a line segment; said light apparatus does not project light between said alignment segment and said aiming spot: said light apparatus and said support are not attached to a golf club or a golfer;

said aiming spot is projected in front of a ball; said alignment segment is projected over said ball and a putter head;

said light apparatus mounted on a support:

whereby said alignment segment is used to align said putter head during a swing.

2. The golf putt training device of claim 1 wherein said light apparatus is comprised of a first light source and a second light source; said first light source projects said alignment segment and said second light source projects said aiming spot;

said alignment segment and said aiming spot are about in a vertical plane:

said light apparatus and said support are not attached to a golf club or a golfer;

said light apparatus is not comprised of flash lights.

3. The golf putt training device of claim 1 wherein said light apparatus is comprised of a first light source and a second light source;

said first light source simultaneously projects said alignment segment and said second light source projects said aiming spot;

said first light source is a first laser device and said second light source is comprised of a second laser device.

4. The golf putt training device of claim 1 wherein said alignment segment has a length between 18 inches and 36 inches long.

5. The golf putt training device of claim 1 wherein said alignment segment has a length between 10% and 25% of the distance between said ball and said aiming point.

6. The golf putt training device of claim 1 which further comprises: an eye alignment device positioned behind said ball under a portion of said alignment segment whereby said eye alignment device allows a golfer's eyes to be maintained in the vertical plane over the ball; said eye alignment device is not attached or part of said putter head; said eye alignment device comprised of at least one vertical panel aligned about parallel with said alignment segment.

7. The golf putt training device of claim 1 which further comprises: an eye alignment device positioned behind said ball and behind said putter head along said alignment segment; said eye alignment device is not attached or part of said putter head;

said eye alignment device comprised of two spaced about vertical panels and a trough; said trough formed by the inside surfaces of said vertical panels; said eye alignment device positioned behind said ball with said alignment segment positioned between said vertical panels; whereby said eye alignment device allows a golfer's eyes to be maintained in the vertical plane over the ball.

8. The golf putt training device of claim 1 wherein said alignment segment consists or one line segment or more than one disconnected line segments; and said alignment segment has a length between about 80% and 120% of the length of the putter head swing length.

9. The golf putt training device of claim 1 wherein said putter further comprise a putter head mark on the top or said putter head about perpendicular with the face of said putter;

an eye alignment device positioned behind said ball and behind said putter head along said alignment segment; said eye alignment device is not attached or part of said putter head;

wherein the swing of said putter is adjusted so that said putter head mark remains aligned with said alignment segment.

10. The golf putt training device of claim 1 wherein said light apparatus adapted to simultaneously project said alignment segment and said aiming spot on said playing surface; said light apparatus and said support are not attached to or part of a golf club or a golfer.

11. A golf putt training device of claim 1 wherein said light apparatus is comprised of a beam spreader; said light apparatus configured so that a first light source emits a first light beam that passes through said beam spreader to project said alignment segment.

12. A golf putt training device comprising:

a light apparatus adapted to simultaneously project an alignment segment and an aiming spot on a playing surface; said aiming spot is projected in front of a ball; said alignment segment is projected over said ball and a putter head; said alignment segment is comprised of at least one line segment; said alignment segment and said aiming spot are about in a vertical plane;

said light apparatus is adapted not to project any light between said alignment segment and aiming spot;

said light apparatus is mounted on a support; said light apparatus is not attached to a golf club or a golfer;

whereby said alignment segment is used to align said putter head during a swing.

13. A golf putt training device comprising:

a light apparatus adapted to project at least an alignment segment on a playing surface in the area where a putter swing will be made; said alignment segment is projected over a ball and a putter head; said alignment segment is comprised of at least one line segment;

a putter club is comprised of said putter head;

said light apparatus is mounted on a stationary support;

an eye alignment device comprised or at least one vertical panel aligned in parallel with said alignment segment; said eye alignment device is not attached to said putter club or is not part of said putter club;

whereby said alignment segment is used to align said putter head during a swing and said eye alignment device is used to maintain the golfer's eyes in the vertical plane over the ball.

14. A golf putt training device of claim 13 wherein said eye alignment device comprises: two spaced vertical panels; said eye alignment device is not attached or part of said putter head.

15. A golf putt training device comprising:

a light apparatus adapted to project simultaneously an alignment segment and an aiming spot on a playing surface; said alignment segment is comprised of at least one line segment; said aiming spot is projected in front of a ball; said alignment segment is projected over said ball and a putter head;

said alignment segment and said aiming spot are about in a vertical plane;

said light apparatus is mounted on a support;

said light apparatus is adapted not to project any light between said alignment segment and an aiming spot;

whereby said alignment segment is used to align said putter bead during a swing;

an eye alignment device comprised of at least one vertical panel aligned in parallel with said alignment segment; said eye alignment device is not attached to said putter club or is not part of said putter club; said eye alignment device positioned behind said hall along said alignment segment;

whereby said alignment segment is used to align said putter head during a swing and said eye alignment device is used to maintain the golfer's eyes in the vertical plane over the ball.

16. The golf putt training device or claim 15 which further includes:

said eye alignment device comprised of two spaced about vertical panels mounted to a base panel; a trough between the vertical panels; said eye alignment device positioned behind said ball and putter head with said alignment segment positioned between said vertical panels; whereby said eye alignment device allows a golf's eyes to be maintained in the vertical plane over the ball;

the eye alignment device is not attached to the golf club or a golfer.

17. The golf putt training device of claim 15 which further includes:

said light apparatus pivotally mounted on a stationary support so that the light apparatus can pivot on a vertical plane of rotation;

the light apparatus is not attached to a golf club or a golfer.

18. A golf putt training device of claim 15 wherein said light apparatus is comprised of a beam spreader; said light apparatus configured so that said first light source emits a first light beam that passes through said beam spreader to project said alignment segment;

said first light source is comprised of a first laser diode and said second light source is comprised of a second laser diode.

19. A golf putt training device of claim 15 wherein said light apparatus is comprised of a first light source and a second light source; said first light source projects said alignment segment and said second light source projects said aiming spot;

said light apparatus is comprised of a beam spreader; said light apparatus configured so that said first light source emits a first light beam that passes through said beam spreader to project said alignment segment;

said first light source is comprised of a first laser diode and said second light source is comprised of a second laser diode.

20. A golf putt training device comprising:

a light apparatus, a base for supporting said light apparatus, said base having alignment support means that enables said light apparatus to simultaneously project an alignment segment on a playing surface, and to project an aiming spot on said playing surface with said alignment sequent being projected over said ball and a putter head, said alignment segment is comprised of at least one line segment; said base is not attached to putter club of the putter head;

said light apparatus does not project light between said alignment segment and said aiming spot:

said light apparatus and said base are not attached to a golf club or a golfer:

whereby said alignment segment is used to align said putter head during a swing.

* * * * *